US005733180A

United States Patent [19]

Kilde

[11] Patent Number: 5,733,180

[45] Date of Patent: Mar. 31, 1998

[54] SANDING MACHINE

[75] Inventor: Bjarne Kilde, Hovedgård, Denmark

[73] Assignee: S. F. Kilde A/S, Skive, Denmark

[21] Appl. No.: 545,581

[22] PCT Filed: May 17, 1994

[86] PCT No.: PCT/DK94/00194

§ 371 Date: Nov. 3, 1995

§ 102(e) Date: Nov. 3, 1995

[87] PCT Pub. No.: WO94/27781

PCT Pub. Date: Dec. 8, 1994

[30] Foreign Application Priority Data

May 17, 1993 [DK] Denmark ..... 9300243

[51] Int. Cl.[6] ..... B24B 7/28; B24B 29/00

[52] U.S. Cl. ..... 451/65; 451/130; 451/150; 451/167

[58] Field of Search ..... 15/22.2, 77; 451/103, 451/108, 109, 124, 150, 130, 131, 153, 164, 167, 65

[56] References Cited

U.S. PATENT DOCUMENTS

| | | | |
|---|---|---|---|
| 1,610,419 | 12/1926 | Brown | 451/130 X |
| 1,669,989 | 5/1928 | Madsen | 451/130 |
| 1,862,277 | 6/1932 | Moon . | |
| 4,361,986 | 12/1982 | van der Linden . | |
| 5,291,689 | 3/1994 | Hundebol | 451/124 |
| 5,361,544 | 11/1994 | Yang | 451/130 X |

FOREIGN PATENT DOCUMENTS

| | | | |
|---|---|---|---|
| 22849 | 9/1930 | Austria | 451/130 |
| 529809 | 7/1957 | Belgium | 451/167 |
| 136103 | 1/1930 | Denmark . | |
| 602297 | 7/1978 | Denmark . | |
| 49730 | 11/1889 | Germany | 451/130 |

*Primary Examiner*—Timothy V. Eley
*Attorney, Agent, or Firm*—Jacobson, Price, Holman & Stern, PLLC

[57] ABSTRACT

A Sanding machine for sanding of workpieces including relief formations passed in a direction of conveyance through the sanding machine, the sanding machine comprising sanding heads extending transverse to the direction of conveyance of workpieces passed through the machine to lengthwise sand the workpieces, and sanding drums staggered along the direction of conveyance of workpieces passed through the machine, each of the sanding drums having a rotation shaft aligned substantially parallel with the direction of conveyance of workpieces passed through the machine, the sanding drums being movable horizontally in a direction substantially parallel to the direction of extension of the sanding heads for allowing a cyclic movement of the sanding drums from side to side in the machine during sanding of the workpieces as the workpieces are conveyed through the machine.

7 Claims, 2 Drawing Sheets

SANDING MACHINE

FIELD OF THE INVENTION

The product concerns a run-thru sander for wood sanding and lacquer-intermediary sanding of panel covers etc., mainly plane workpieces. The surface of the workpiece is not necessarily plane (meaning smooth), but may include profiles and structurings or similar "relief formations". The sanding and polishing require, abrasives of the laminated type (e.g. the FLADDER type), with abrasive slats mounted next to each other in a rotating sanding head. The sanding heads sand the workpieces passing through the machine by the slats' "elastic" stroking of the workpiece surface. The necessary sanding pressure for the process arises from a combined effect of the centrifugal power during rotation of the sanding head, the natural rigidity of the slats and the effect of the stiff support brushes placed between the slats. The sanding is a result of the total effect of the slats.

BACKGROUND OF THE INVENTION

Various types of run-thru sanders of the mentioned type are known. They are based on slat sanding heads and sanding drums. Sanding drums positioned with their axis of rotation perpendicular to the direction of the feeding belt, process the workpiece surface during a sanding operation "lengthwise" and simultaneously across the full width of the workpiece. On panel covers with both lenghtwise and transverse profiles, only the lenghtwise profiles will be processed (sanded) in depth, since the sanding slats are not able or, only to a certain extent, capable of getting to the bottom ofthe transverse profiles, so they remain unprocessed. Attempts have been made to solve the problem by using a number of disk shaped sanding heads in sanding machines. One type of sanding head is shaped like a circular disc provided with sanding slats on the side. The sanding head, with the slats turned down towards the workpiece, rotates about its vertical axis. The slats rotate at the level of the workpiece, and will therefore partially rotate parallel to the transverse profiles of the workpiece. Theoretically a finished sanding of the surface of the workpiece would be expected also in the depth of the profiles, but it does not occur. The sanding result is far from satisfactory.

SUMMARY OF THE INVENTION

The purpose of this invention is to present a sander, which in a quite effective and well-defined way is able to perform a process of wood sanding and intermediate lacquer sanding of workpieces of the kind concerned. In this way subsequent finish-sanding, manually for example, will be rendered superfluous.

Apart from the mentioned transverse sanding drums the new sanding machine also consists of lengthwise positioned sanding drums in the machine in order to sand the workpiece in two perpendicular directions during one operation. The workpiece is sanded at two right angles to each other during one operation. The sanding drums are cylinder shaped with radial placed sanding slats. The transverse mounted sanding drums, i.e. with the axis of rotation laying in the direction of the machine, workpiece conveyance sand the workpiece transversely in relation to the workpiece conveyance direction, are arran- ged in a position to move cyclically from side to side in the machine during operation of the workpiece, so that the workpiece is sanded along its full width by the lengthwise positioned sanding drums as well.

The feeding belt speed, the cyclic variation frequency, and the number of revolutions of the sanding drums are individually adjusted, in consideration that the workpiece must be sanded as equally as possible on the entire surface in a finish pattern actually characterized as cross sanding.

Due to the cyclic variation from side to side by the sander, the lengthwise sanding drums (together with the traverse sanding drums) cause a complete and equal sanding of all points of the workpiece. The sanding drums sand the workpiece during their rotation with a relatively high number of revolutions, which makes the sanding slats effect the profiles of the workpiece when sanding "transversely". The profiles which extend transverse of the sanding direction of the machine, also obtain a careful and thorough sanding from the sanding slats, which are now able to make contact with the profiles, lengthwise and also along the bottom and sides of the profiles as well.

The new sander, and chosen particular advantageous examples of the invention will be explained in detail below with reference to the figures of the drawings.

DETAILED DESCRIPTION OF THE PREFERRED EMBODIMENTS

Figure 1:
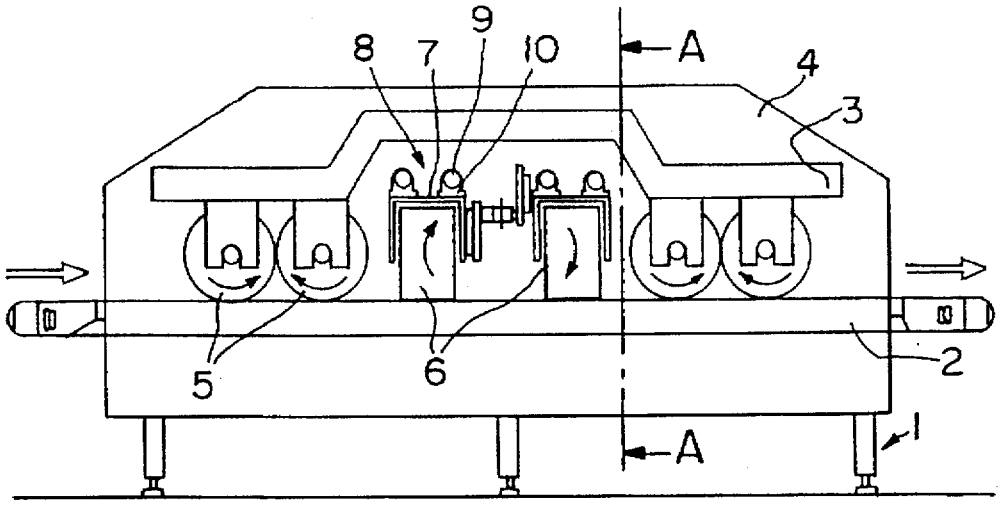
FIG. 1 shows a run through sander according to the invention, seen from the side.
Figure 2:
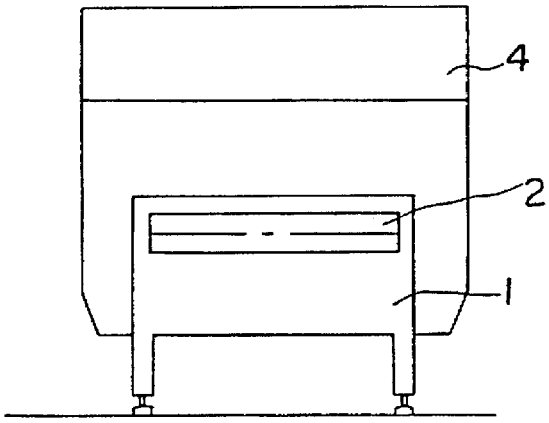
FIG. 2 shows the sander seen from the in-feed end, FIG. 3 schematically shows the run through sander seen from the top.

In the embodiment shown in FIGS. 1 through 6 the sander consists mainly of a bottom frame (1), a lengthwise extending horizontal feeding belt (2) built in the frame as an independent unit, a top frame (3), which supports the various sanding devices, and a screen (4). An auxiliary frame, not shown is the drawings carrying a number of thrust rollers, is mounted between the belt (2) and the frame (3). The frame (3) is vertically adjustable by means of a motorized, central controlled device, which includes spindle gear in each corner of the frame as well as connecting shafts between the spindle gears.

Figure 3:
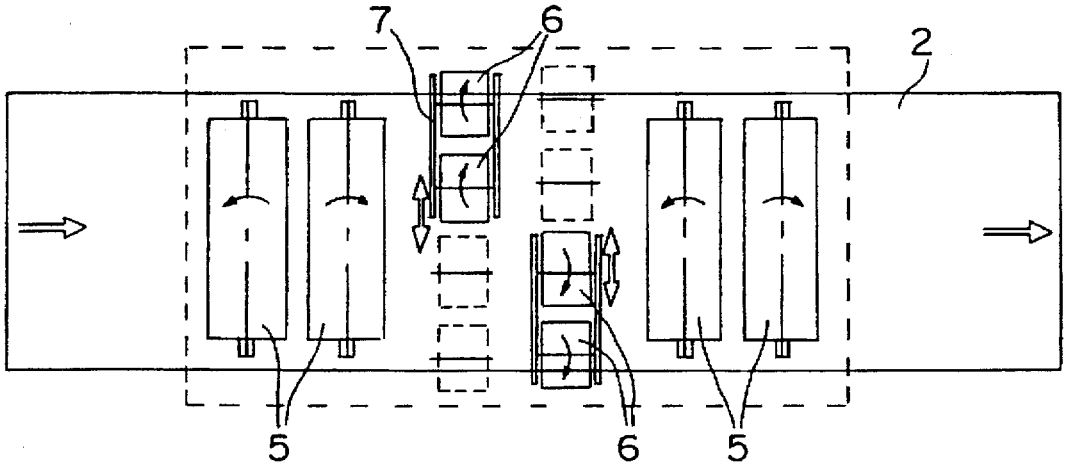
Figure 4:
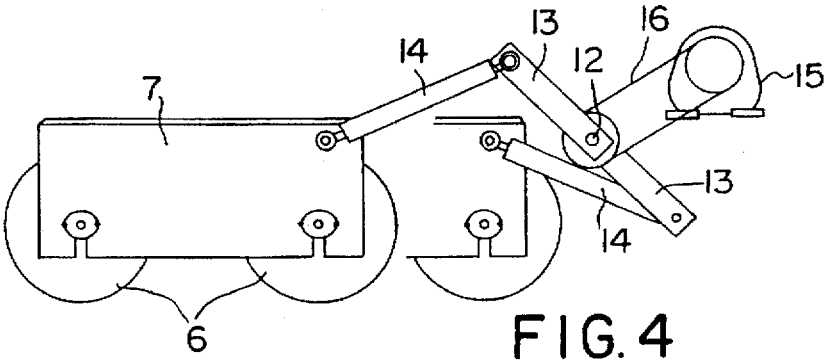
FIG. 4 illustrates an enlarged section of the lenghtwise sanding drums with sliding brackets, guidings and crank gear, shown from the side taken along line A—A in FIG. 1.
Figure 5:
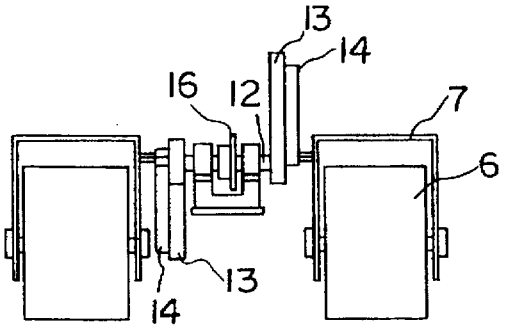
FIG. 5 illustrates the sanding drumas as seen from one end of the sander.
Figure 6:
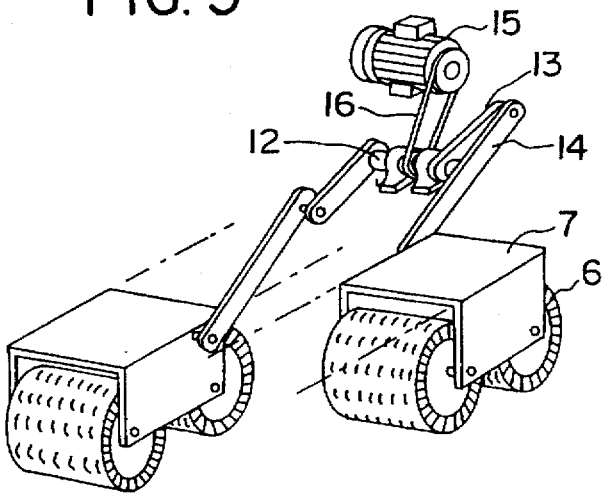
FIG. 6 is a perspective view of the sanding drums.

The sanding devices consist of four transverse sanding drums (5), each arranged in two sets of two devices, and four lengthwise sanding drums (6), placed two by two in slide-like brackets (7) transversely, movable on the belt (2). The transverse sanding drums (5) extend the full width (are equal to the belt width, as shown in FIG. 3) of the machine and are operated separately by a motor not shown. The lengthwise sanding drums (6) are operated in pairs by motors mounted directly on the brackets (7). The different sanding motors have adjustable numbers of revolution by means of frequency converter(s). The motor operating is similarly operated. (2) The rotation direction of the sanding drums and, the infeed direction of the belt are indicated in the drawings by arrows.

The two sliding brackets (7) are placed next to each other on two parallel sets of transverse guidings (8). These guidings, which are mounted on the frame (3), are made of hardened shafts (9) and ball bearings (10). The slidings (7) are driven back and forth on the guidings by means of a joint connecting drive rod (11), mounted between the slidings. The connecting drive rod consists of a short central shaft (12), which in each end includes an arm (13). The two arms are offset 180°compared to each other. Linked connecting rods (14) are placed between the arms and slidings. The linked connecting rods convert the shaft's (12) rotation to a linear back and forth sliding movement. The two slides move in opposite push-pull directions with regard to the balancing of the moving elements. The shaft (12) is operated by a geared motor (15) via a chain drive (16). The geared motor has a variable number of revolutions by means of a frequency converter. The working frequency of the slidings are adjusted to the feeding speed of the belt, so that all parts of the operated work pieces are processed by each slide.

Figure 8:
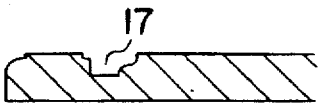
Figure 7:
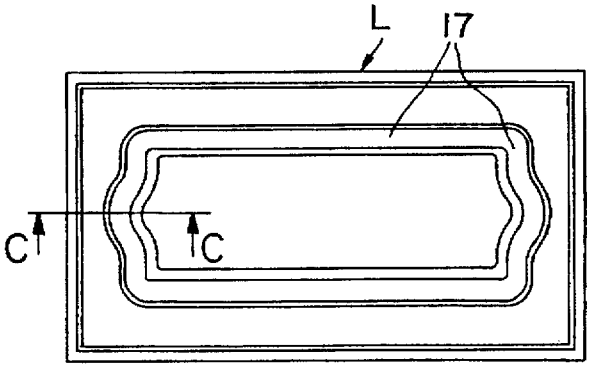
FIG. 7 illustrates a typical workpiece (a panel cover) seen from the top which is the side to be sanded and, FIG. 8 is an enlarged section taken along the line B—B in FIG. 7.

FIGS. 7 and 8 show a typical work piece —a panel cover L with cutout profiles 17. The invention is not limited to the embodiment shown in the drawings and described above. All combinations of material, other detail shapes and constructive solutions for the single parts of the machine are possibly within the framework of the invention as well as the number of sanding drums and their mutual arrangement is variable within the scope of the principles the invention.

I claim:

1. A sanding machine for sanding of workpieces including relief formations passed in a direction of conveyance through the sanding machine, said sanding machine comprising:

sanding heads extending transverse to the direction of conveyance of workpieces passed through the machine to lengthwise sand the workpieces, and sanding drums staggered along the direction of conveyance of workpieces passed through the machine, each of said sanding drums having a rotation shaft aligned substantially parallel with the direction of conveyance of workpieces passed through the machine, said sanding drums being movable horizontally in a direction substantially parallel to the direction of extension of said sanding heads by suspensions and guides for allowing a cyclic movement of said sanding drums from side to side in the machine during sanding of the workpieces as the workpieces are conveyed through the machine.

2. The sanding machine according to claim 1, wherein said sanding drums are suspended in two parallel guides and said guides are mounted in synchronous moving brackets, and said brackets are reciprocated by a double connection drive rod.

3. The sanding machine according to claim 1, wherein a through-going belt feeds workpieces through the machine, and a vertically adjustable top frame is located over said belt, and said brackets of said sanding drums are suspended from said top frame.

4. A sanding machine comprising:

a frame, a belt for conveying workpieces through said frame in a predetermined direction, sanding heads located in said frame and each of said sanding heads having an axis of rotation extending perpendicular to said predetermined direction, and sanding drums located in said frame between said sanding heads, said sanding drums each having an axis of rotation extending parallel to said predetermined direction, each of said sanding drums being reciprocally mounted for movement in a direction perpendicular to said predetermined direction.

5. A sanding machine as claimed in claim 4, wherein pairs of said sanding drums are staggered from each other along said predetermined direction.

6. A sanding machine as claimed in claim 5, wherein two pairs of said sanding drums are staggered from each other along said predetermined direction.

7. A sanding machine as claimed in claim 5, wherein each pair of said sanding drums is separately reciprocated across said predetermined direction of conveyance.

* * * * *